United States Patent [19]

Deutsch

[11] Patent Number: 4,649,787

[45] Date of Patent: Mar. 17, 1987

[54] ENSEMBLE TONE GENERATION IN A MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 765,635

[22] Filed: Aug. 15, 1985

[51] Int. Cl.[4] ..... G10H 1/02; G10H 7/00

[52] U.S. Cl. ..... 84/1.22; 84/1.24; 84/DIG. 4

[58] Field of Search ..... 84/1.22–1.24, 84/DIG. 4

[56] References Cited

U.S. PATENT DOCUMENTS 4,342,248 8/1982 Deutsch et al. ..... 84/1.24

4,353,279 10/1982 Deutsch ..... 84/1.24

*Primary Examiner*—S. J. Witkowski

*Attorney, Agent, or Firm*—Ralph Deutsch

[57] ABSTRACT

In a musical instrument in which a plurality of data words corresponding to the amplitudes of a corresponding number of evenly spaced points defining a cycle of an audible musical waveform are transformed at an average rate corresponding to the fundamental frequency of the tone being generated, a computation means is provided to produce musical tones having an ensemble effect. The computation means comprises a multiplicity of interpolation calculations whereby a sequence of interpolated waveshape points are obtained from two different waveshapes whose data points are addressed from waveshape memories at different memory advance rates.

15 Claims, 5 Drawing Figures

ENSEMBLE TONE GENERATION IN A MUSICAL INSTRUMENT

BACKGROUND OF THE INVENTION

1. Field of the Invention

This invention relates to musical tone synthesis and in particular is concerned with an improvement for producing tones having an ensemble effect.

2. Description of the Prior Art

It is well known that the tonal quality of an electronic musical instrument is enhanced by generating tones which have an ensemble quality. The usual method of producing an ensemble effect is to generate two or more tones whose fundamental frequencies differ by some small frequency difference. The motivation for this arrangement of frequencies is to replicate the ensemble tone produced by a chorus of musical instruments which are not precisely in tune. It is this attribute of "out-of-tune" ensemble that produces the warm tone characteristic of a group of violins even when they are played in unison.

Various arrangements have been employed to electronically generage two simultaneous tones which are slightly detuned with respect to each other. The straightforward arrangement is to simply duplicate each tone generator and to use detuned clocks to drive the tone generators. This arrangement is plagued by the practical problem of implementing two independent clocks which must be only slightly out-of-tune and cannot be permitted to drift independently in frequency with changes in their ambient conditions.

In U.S. Pat. No. 3,809,792 entitled "Production Of Celeste In A Computer Organ" a system is described for producing a celeste version of ensemble tone by computing the amplitudes at successive sample points of a musical waveshape and converting the amplitudes to musical tones as the computations are carried out in real time. Each amplitude point is computed during the regular time interval by individually calculating and combining at least two sets of discrete Fourier components. The first set includes harmonically related components, generally the true pitch fundamental frequency and overtones of each keyboard selected note. The components of the second set are generated to be offset slightly higher in frequency than those in the first set.

In U.S. Pat. No. 4,112,803 entitled "Ensemble And Anharmonic Generation In A Polyphonic Tone Synthesizer" apparatus is disclosed for producing an ensemble effect in a polyphonic tone synthesizer of the type wherein musical tones are produced polyphonically by computing a master data set, transferring the data set to buffer memories, and repetitively converting in real time the contents of the buffer memories, and repetitively converting in real time the contents of the buffer memories to analog musical waveshapes. A multiplicity of master data sets are created repetitively and independently of tone generation by computing a generalized Fourier-type algorithm using stored sets of harmonic coefficients. The phase of these master data sets are generated with time varying phase shifts to produce the out-of-tune ensemble tone effect. The phase shifted master data sets are combined and transferred to the buffer memories.

In U.S. Pat. No. 4,205,580 entitled "Ensemble Effect In An Electronic Musical Instrument" apparatus is disclosed for producing an ensemble effect in a polyphonic tone synthesizer by providing a master data set of words having values corresponding to the relative amplitudes of equally spaced points along one cycle of the waveform of a musical tone. These values are transferred sequentially during the repetitive cycles at a rate proportional to the pith of the desired musical tone to a digital-to-analog converter for converting the master data set to an audio signal of the desired waveform and pitch. The ensemble effect is produced by transferring the words of the master data set to a second converter at the same clock rate but having one data point deleted or repeated once in the second set.

In U.S. Pat. No. 4,353,279 entitled "Apparatus For Producing Ensemble Tone In An Electronic Musical Instrument" a system is disclosed for producing an ensemble effect in a digital tone generator by providing a master data set of words having values corresponding to the relative amplitudes of equally spaced points along one cycle of a waveform of a musical tone in which the fundamental frequency has been deleted. These values are read sequentially and repetitively from a memory to produce a first analog tone. A second analog tone is produced by multiplying a data set corresponding to the fundamental frequency by a low frequency sinusoid waveshape set of points. The first and second analog tones are summed to yield a musical tone having an ensemble effect.

In U.S. Pat. No. 4,476,691 entitled "Selectable Ensemble Effect In An Electronic Musical Instrument" a system is described for producing an ensemble effect in a digital tone generator by implementing a plurality of tone generators such that each has an ensemble tone effect created by adding together a number of composite tones. The tone generation is produced by sequentially and repetitively accessing a memory containing a set of data points which define a period of a preselected musical waveshape. Each tone generator is implemented by selected a corresponding set of data points read out of memory. The selection logic is controlled by select gates and a comparator which is responsive to the frequency of an associated actuated keyboard switch.

SUMMARY OF THE INVENTION

The present invention is directed toward a system for improving the tone quality produced by a system described in detail in U.S. Pat. No. 4,085,644 entitled Polyphonic Tone Synthesizer. The improvement is obtained by using a computation cycle and a data transfer cycle which are repetitively and independently implemented to provide data which are converted into musical waveshapes having an ensemble effect. A sequence of computation cycles is implemented each of which consists of a subset of two subcomputation cycles. During the first subcomputation cycle a first master data set of points is computed which define the period of a first musical waveshape which is stored in a first waveshape memory and during the second subcomputation cycle a second subcomputation cycle a second master data set of points is computed which define the period of a second musical waveshape which is stored in a second waveshape memory.

A frequency number is generated which corresponds to an actuated keyboard switch. The frequency number is used to implement a non-integer frequency generator by periodically adding the frequency number to an accumulator in an adder-accumulator combination. The integer portion of the accumulated sum of the frequency number is used to address out data values from a first waveshape memory which stores the first master data set of points and to address out data values from a second waveshape memory which stores the second master data set of points. The fraction portion of the accumulated frequency number is used to compute a first interpolated data point between two successive data points read out from the first waveshape memory. Similarly the same fraction portion is used to compute a second interpolated data point between two successive data points read out from the second waveshape memory.

An offset, or out-of-tune, frequency number is generated by modifying the original frequency number. The offset frequency number is also used in a non-integer frequency generator to create a second accumulated frequency number.

The second accumulated number is used to address data points from the second waveshape memory and to compute a third interpolated data point between two successive data points read out from the second waveshape memory.

A third interpolation process is implemented to interpolate between the successive first interpolated points, successive second interpolated points, and between successive interpolated points to generate a sequence of data points corresponding to a musical tone having an ensemble effect. This sequence of data points is converted into an analog signal which in turn produces an audible musical tone.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed towards an improvement in the tone quality produced by a system described in detail in U.S. Pat. No. 4,085,644 entitled Polyphonic Tone Synthesizer. This patent is hereby incorporated by reference. In the following description all elements of the system which are described in the referenced patent are identified by two digit numbers which correspond to the same numbered elements appearing in the referenced U.S. Pat. No. 4,085,644.

Figure 1:
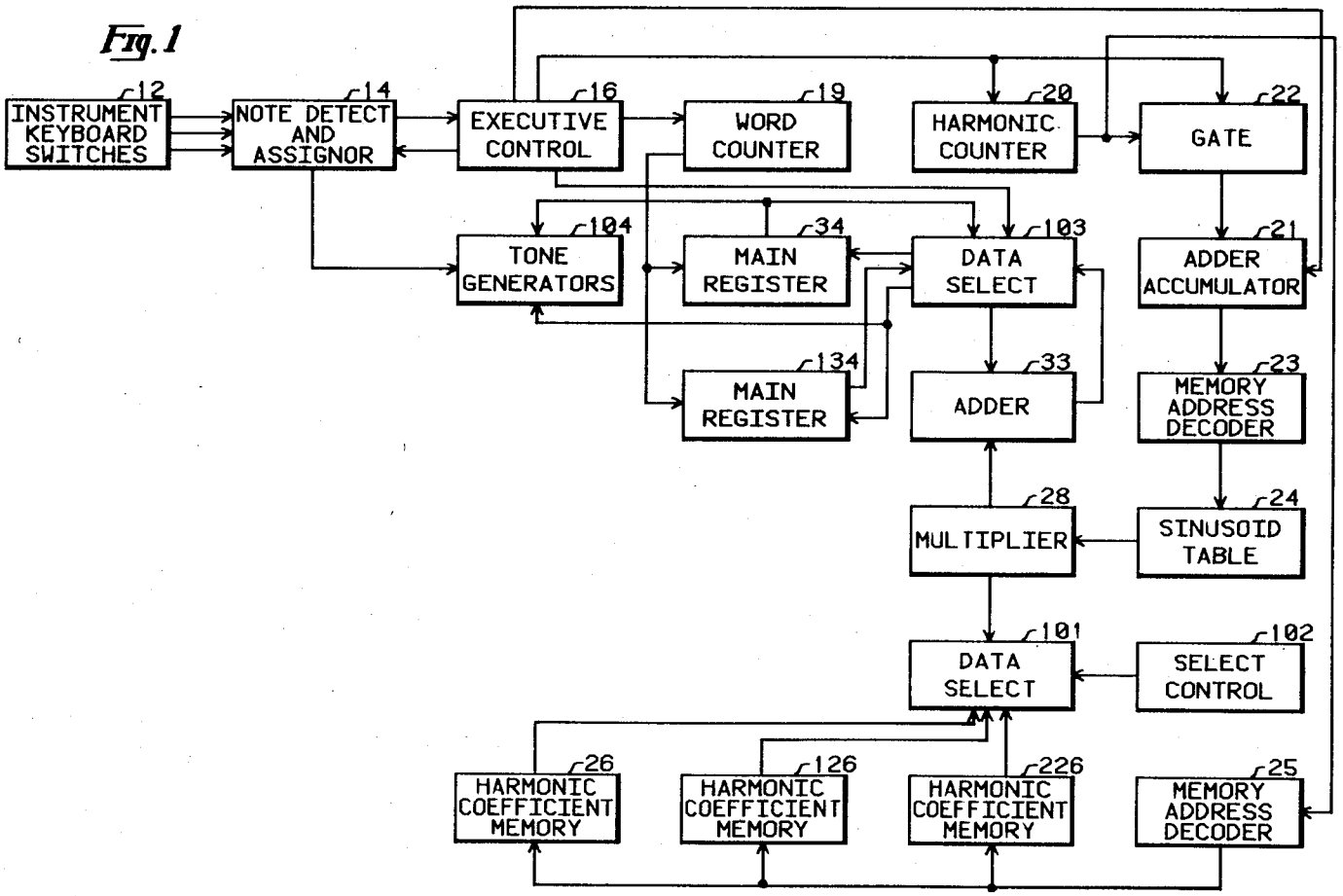
FIG. 1 is a system block diagram of the musical waveform generator.

FIG. 1 shows an embodiment of the present invention which is described as a modification and adjunct to the system described in the referenced U.S. Pat. No. 4,085,644. The preferred embodiment is one in which a computation cycle is initiated to compute a master data set which is then transferred to a note register associated with a single asigned tone generator. As soon as the transfer of the master data set is completed, a second computation cycle is immediately started to compute an independent master data set for a second assigned tone generator. This sequence of a computation cycle followed by a transfer cycle is continued until a new master data set has been computed and transferred to each of the assigned tone generators. At this time the complete computation and transfer process is repeated so that each of the tone generators are individually and continuously supplied with constantly updated independent master data sets. This operation sequence permits an independent ensemble effect to be implemented for the subset of assigned tone generators.

As described in the above referenced patent the Polyphonic Tone Synthesizer includes an array of instrument keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. A tone generator, contained in the system block labeled tone generators 104, is assigned to eah actuated keyswitch using information generated by the note detect and assignor 14.

A suitable configuration for a note detect and assignor subsystem is described in U.S. Pat. No. 4,022,098. This patent is hereby incorporated by reference.

When one or more keyswitches have been actuated, the executive control 16 initiates a repetitive sequence of individual computation cycles followed by associated transfer cycles. Each computation cycle is partitioned into two subcomputation cycles. During the first subcomputation cycle a first master data set is computed using a set of harmonic coefficients stored in one of the plurality of harmonic coefficient memories 26, 126, 226 . . . . The first master data set is stored in the main register 34. During the second subcomputation cycle a second master data set is computed using a set of harmonic coefficients which usually differs from the set of harmonic coefficients used to compute the first master data set. The second master data set is stored in the main register 134.

As described in the referenced patent 4,085,644 the harmonic counter 20 is initialized to its minimal, or zero, count state at the start of each subcomputation cycle. Each time that the word counter 19 is incremented by the executive control 16 so that it returns to its minimal, or zero count, state because its modulo counting implementation, a signal is generated by the executive control 16 which increments the count state of the harmonic counter 20. The word counter 19 is implemented to count modulo 64 which is the number of data words comprising a master data set. The harmonic counter 20 is implemented to count $64/2=32$ which is equal to the maximum number of harmonics corresponding to the number of words in a master data set which determine the equally spaced points for a period of the generated musical tone.

At the start of each subcomputation cycle, the accumulator in the adder-accumulator 21 is initialized to a zero value by the executive control 16. Each time that the word counter 19 is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric function values from the sinusoid table 24. The sinusoid table is advantageously implemented as a read only memory storing values of the trigonometric function sin $(2\pi\theta/64)$ for $0 \leqq \theta \leqq 64$ at intervals of D. D is a table resolution constant.

The memory address decoder 25 is used to simultaneously read out harmonic coefficients stored in the plurality of harmonic coefficient memories 26, 126, 226 in response to the count state of the harmonic counter 20. While only three such harmonic coefficient memories are shown explicitly in FIG. 1, it is evident from the following description that any number of such memories can be incorporated into the tone generation system.

During the first subcomputation cycle, in response to a signal from the select control 102, the data select 101 selects the harmonic coefficient read out from one of the set of harmonic coefficient memories. During the second subcomputation cycle, in response to a signal from the select control 102, the data select 101 selects harmonic coefficients read out of a different harmonic coefficient memory other than the memory that was selected during the first subcomputation cycle.

The select control 102 can vary the selection of the harmonic coefficient memories as a function of time. Advantageously the select control 102 can be implemented to select the pair of harmonic coefficient memories 26 and 126 when the note detect and assignor 14 has detected that a keyswitch has been actuated. At some later predetermined time interval, the select control 102 will select the output data read from the harmonic coefficient memories 126 and 226. One could proceed in this number and cycle pair-wise amongst the available plurality of harmonic coefficient memories.

The multiplier 28 multiplies the trigonometric function value read out from the sinusoid table 24 by a harmonic coefficient selected by the data select 101 in response to the signal provided by the select control 102.

During both subcomputation cycles, master data set data words are simultaneously read out from the main register 34 and the main register 134 in response to the count state of the word counter 19. During the first subcomputation cycle, in response to a command signal from the executive control 16, the data select 103 selects the data values read out of the main register 34. The selected data values are added to the product value produced by the multiplier 28 by means of the adder 33. The data select 103 then causes the summed values to be stored in the main register 34 at the same address from which the original data value had been read.

Similarly during the second subcomputation cycle, in response to a command signal from the executive control 16, the data select 103 selects the data values read out of the main register 134. The selected data values are added to the product value product by the multiplier by means of the adder 33. The data select 103 then causes the summed values to be stored in the main register 134 at the same address from which the original data value has been dread.

At the completion of both subcomputation cycles a transfer cycle is initiated during which the first master data set stored in the main register 34 and the second master data set stored in the main register 134 are transferred to note registers which are components of each of the plurality of tone generators contained in the system block labeled tone generators 104.

Figure 2:
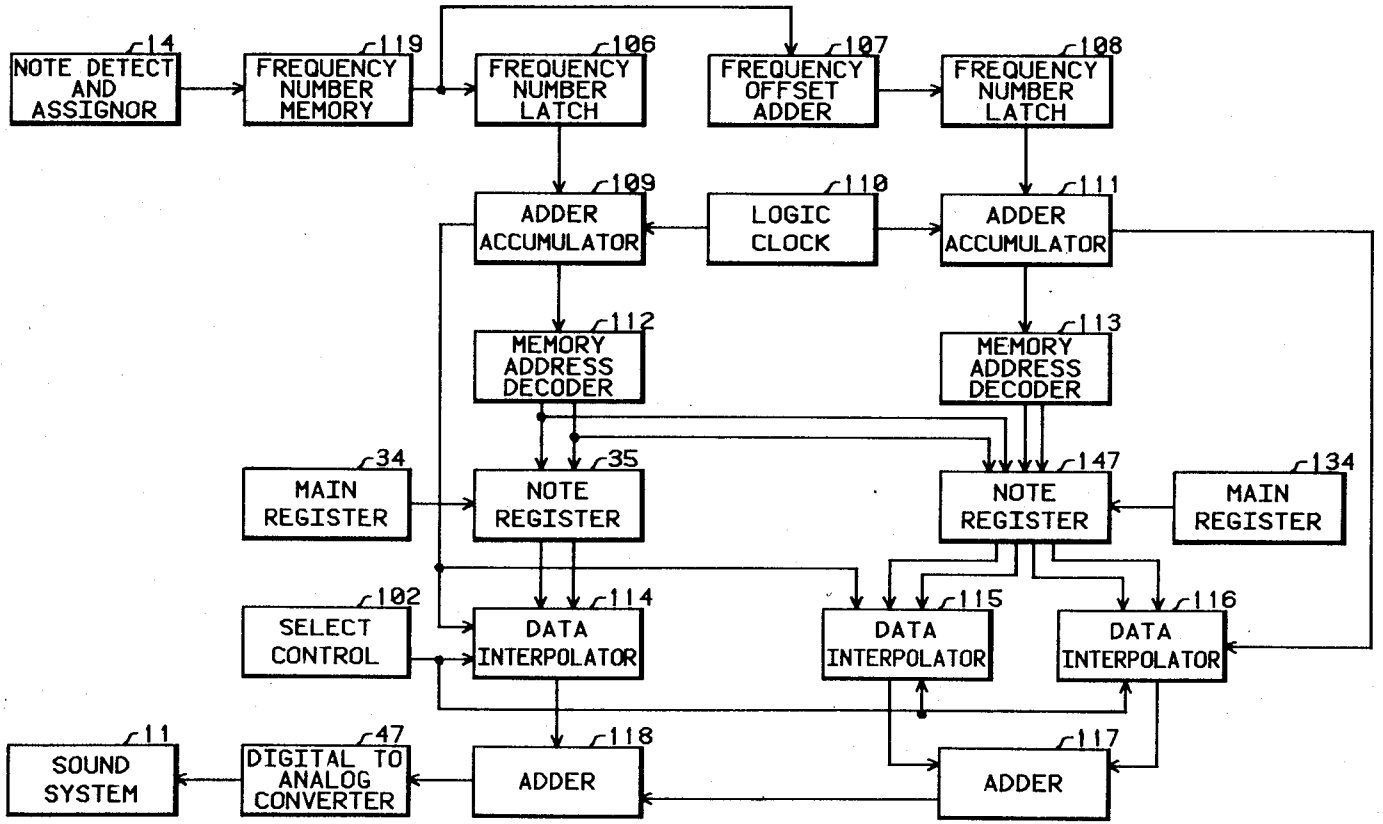
FIG. 2 is a system block diagram of the ensemble generating interpolation subsystem.

The details of the interpolation subsystem used to produce the desired ensemble effect from the first and second master data sets are shown in FIG. 2. While FIG. 2 only explicitly shows a single tone generator, it is evident from the description that the elements can be replicated to provide for any desired number of tone generators.

The present invention produces an ensemble effect by combining an interpolation for wave shape addressing using an accumulated frequency number with an interpolation between two different waveshapes. The pitch or fundamental frequency of a generated musical tone is determined by the assignment of a frequency number to each actuated keyswitch on the musical instrument's array of keyboard switches. The frequency number is successively added to the content of an accumulator. The accumulated frequency number has an integer portion and a decimal, or fraction, portion. The integer portion comprises a set of the most significant bits of the binary number representation for the accumulated frequency number. The fraction portion comprises a set of the least significant bits of this same binary number representation. The integer portion is used to address out waveshape data points which are stored in a waveshape memory. The decimal portion is used to perform an interpolation for the fractional difference between two consecutive waveshape points.

Let $A_j$ denote the stored waveshape data point corresponding to the integer portion of the accumulated frequency. The interpolated waveshape $A_i$ value corresponding to the accumulated frequency is given by the expression $$A_i = F_1(A_{j+1} - A_j) + A_j \qquad \text{Eq. 1}$$
$$= F_1A_{j+1} + (1 - F_1)A_j$$

where $F_1$ denotes the fraction portion of the accumulated frequency number. There is also a second waveshape memory containing a second waveshape set of data points. The interpolated data value obtained from this second waveshape memory corresponding to the same frequency number is given by the expression $$B_i = F_1B_{j+1} + (1 - F_1)B_j \qquad \text{Ew. 2}$$

A third interpolation is made between the interpolated data values $A_i$ and $B_i$. P denotes the fractional value of the third interpolation so that the resulting interpolated value is given by the expression $$C_1 = (B_i - A_i)P + A_i \qquad \text{Eq. 3}$$
$$C_1 = PB_i + (1 - P)A_i$$

By combining Eq. 1 and Eq. 2, $A_i$ and $B_i$ can be eliminated from Eq. 3 to obtain the expression $$C_1 = PF_1B_{j+1} + P(1 - F_1)B_j + (1 - P)F_1A_{j+1} + (1 - P)\text{-}(1 - F_1)A_j. \qquad \text{Eq. 4}$$

The waveshape obtained by the sequence of points $C_i$ will correspond to a waveshape having a fundamental frequency determined by the assigned frequency number.

A second frequency number is obtained by either adding or subtracting an offset value from the true frequency number assigned to the actuated keyboard switch. This second frequency number is also successively added to the content of a second accumulator to form a second accumulated frequency number. The second accumulated frequency number is also used to read out waveshape sample points from the second waveshape. Another interpolation is performed on these waveshape sample points to obtain the interpolated value $$B_k = F_2 B_{m+1} + (1-F_2) B_m \quad \text{Eq. 5}$$

Corresponding to Eq. 3, the new waveshape interpolated value corresponding to the second accumulated frequency number is $$C_2 = (B_k - A_i)P + A_i \quad \text{Eq. 6}$$

Eqs. 2, 4, and 5 can be combined to obtain the result $$C_2 = PF_2 B_{m+} + P(1-F_2)B_m + (1-P)F_1 A_{j+1} + (1-P)(1-F_1)A_2 \quad \text{Eq. 7}$$

If the points $C_1$ and $C_2$ are added together as they are computed in an equally spaced time sequence, the net result is an ensemble effect consisting of two waveshapes which differ in their fundamental frequencies. It is noted that the last two terms in Eq. 4 and Eq. 7 are identical because these terms are the same result of a double interpolation of the first waveshape set of data points.

When the note detect and assignor 14 detects that a keyboard switch has been actuated, a corresponding frequency number is read from the frequency number memory 119. The frequency number memory 100 can be implemented as a read-only addressable memory (RAM) containing data words stored in binary numeric format having values $2^{-(M-N)/12}$ where N has the range of values N=1, 2, . . . , M and M is equal to the number of keyswitches on the musical instrument's keyboard. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 119 is stored in the frequency number latch 106. In response to timing signals produced by the logic clock 110, the frequency number contained in the frequency number latch 106 is successively added to the content of the accumulator contained in the adder-accumulator 109. The content of the accumulator is the accumulated sum of a frequency number.

During the transfer cycle associated with the tone generator shown explicitly in FIG. 2, the first master data set contained in the main register 34 is copied into the note register 35 and the second master data set contained in the main register 134 is copied into the note register 147.

In response to the integer portion of the accumulated frequency number contained in the adder-accumulator 109, the memory address decoder 112 reads out two consecutive data words from the note register 35 which are provided as data input to the data interpolator 114. This memory read out is implemented to be modulo the number of memory addresses contained in the note register 35. Thus if the highest memory address word is read out the second read out word of the pair will be read from the lowest memory address.

The data interpolator 114 uses the decimal portion of the accumulated frequency number contained in the adder-accumulator 109 for the fraction value $F_1$ displayed explicitly in Eq. 4. The value of P, required for the interpolation between the two waveforms is furnished by the select control 102. The data interpolator 114 performs the calculated corresponding to the last two terms in Eq. 4. It has been noted that these are the same as the last two terms in Eq. 7.

The frequency offset adder 107 adds a fixed predetermined number to the frequency number read out of the frequency number memory 106. The modified frequency number is stored in the frequency numer latch 108. Alternatively instead of an adder, a subtract operation could be used to subtract a predetermined number from the frequency number read out from the frequency number memory 119 to obtain the modified, or out-of-tune, frequency number. Another alternative is to vary the incrementing frequency offset number as a function of the true frequency number read out from the frequency number memory 119.

The modified, or out-of-tune, frequency number stored in the frequency number latch 108 is successively added to the contents of the accumulator in the adder-accumulator 111 in response to the timing signals provided by the logic clock 110. In response to the integer portion of the accumulated frequency number in the adder-accumulator 111, the memory address decoder 113 reads out two consecutive data words from the note register 147. The two read out data words are provided as input data to the interpolator 116. This memory read out is also implemented to be modulo the number of memory addresses contained in the note register 147.

In response to the integer portion of the accumulated frequency number in the adder-accumulator 112, the memory address decoder 112 reads out two consecutive data words from the note register 147. The read out data is provided as input data to the data interpolator 115.

The data interpolator 115 computes the first two terms for $C_1$ shown in Eq. 4. The data interpolator computes the first two terms for $C_2$ shown in Eq. 7. The results of the computations for the data interpolators 115 and 116 are added together by means of the adder 117.

The output data value computed by the data interpolator 114 is left shifted in the data interpolator 114 to double its value. The result is provided as one input to the adder 118. A second input to the adder 118 is the output from the adder 117. The output from the adder 118 consists of a sequence of data point values which correspond to the sum of two out-of-tune waveshapes. The data output values from the adder 118 are converted into an analog signal by means of the digital-to-analog converter 47. The resulting analog signal is converted into a musical sound by means of the sound system 11 which consists of an amplifier and speaker combination.

Figure 3:
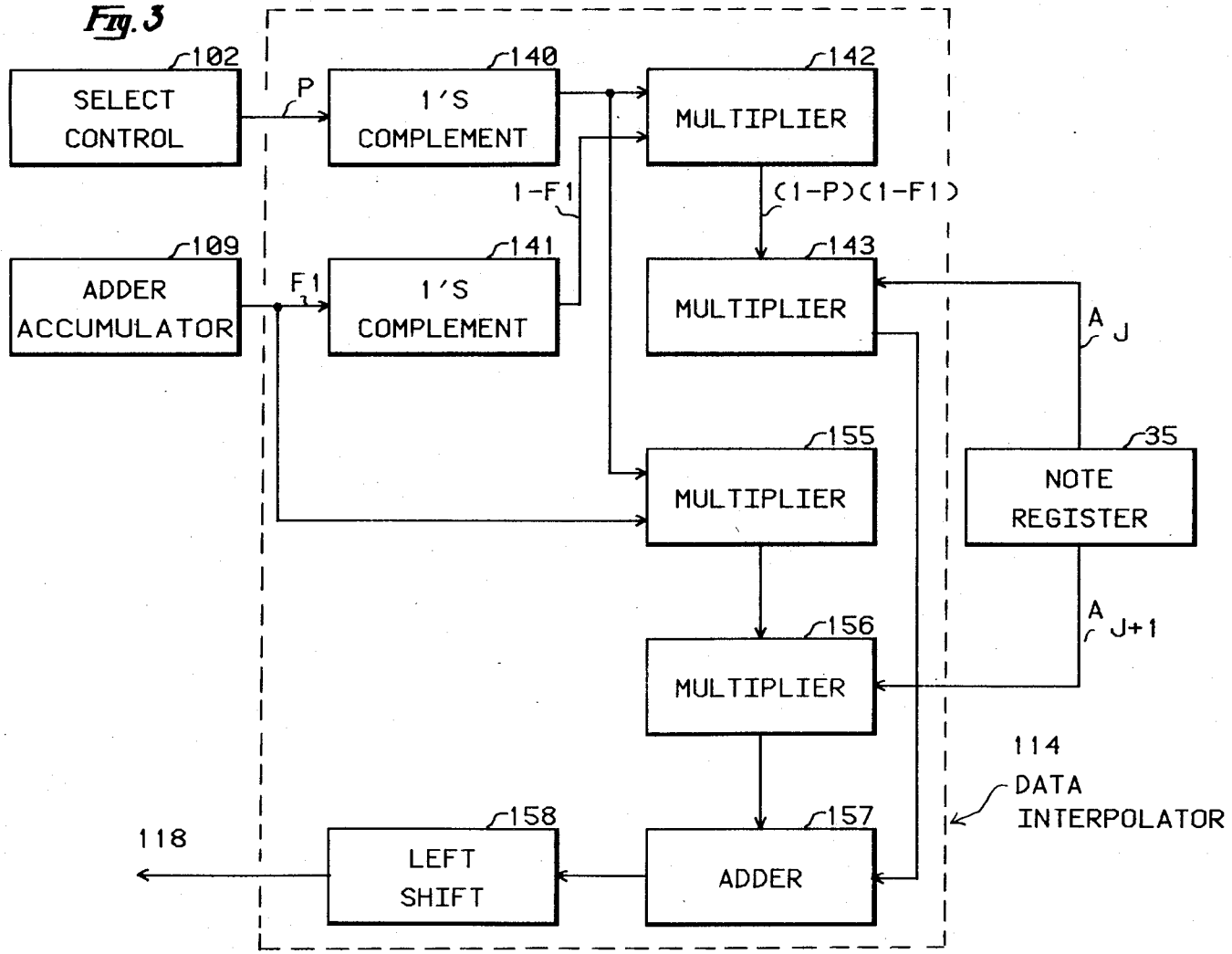
FIG. 3 is a system block diagram of the data interpolator 114.

FIG. 3 illustrates the system logic details of the data interpolator 114. The 1's complement 140 performs a 1's complement binary operation on the binary coded value of the interpolation parameter P furnished by the select control 102. The result of this operation is the binary value corresponding to the decimal value 1−P. The 1's complement 14 performs a 1's complement binary operation of the fraction portion of the accumulated frequency number F1 contained in the adder-accumulator 109. The result of this operation is the binary value corresponding to the decimal value $1-F_1$.

The multiplier 142 forms the product of the output from the two 1's complement operation to yield the product term $(1-P)(1-F_1)$. The multiplier 143 forms the product of the output of the multiplier 142 with the first term of the pair of data values read out of the note register 35. The multiplier 155 forms the product of $F_1$ and $1-P$ to yield the product term $(1-P)F1$. The multiplier forms the product of the output of the multiplier 155 with the second term $A_{j+1}$ of the pair of data values read out of the note register 35. The adder 157 sums the product values produces by the multiplier 143 and the multiplier 156. The summed value produced by the adder 157 is the last two terms of Eq. 4 and Eq. 7. The left shift 158 performs a binary left shift of one binary bit position thereby doubling its input data value.

Figure 4:
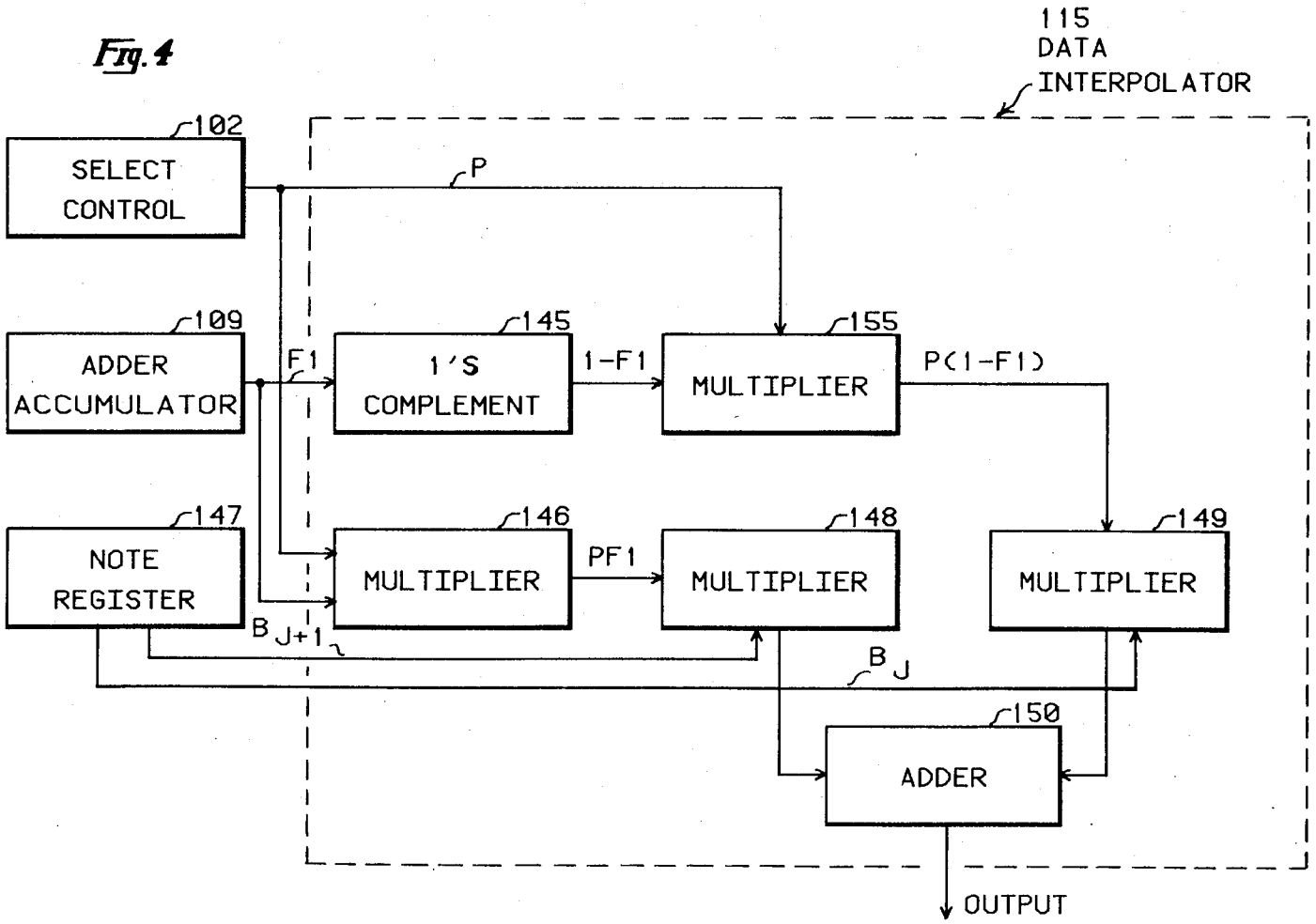
FIG. 4 is a system block diagram of the data interpolator 115.

FIG. 4 illustrates the system logic details of the data interpolator 115. The purpose of the data interpolator 115 is to compute the first two terms on the right hand side of Eq. 4. The multiplier 146 forms the product of the interpolation parameter P furnished by the select control 102 and F1 which is the fraction portion of the accumulated frequency number contained in the adder-accumulator 109. The multiplier 148 forms the product $PF_1B_{j+1}$. $B_{j+1}$ is the second term of the pair of data values read out from the note register 147 in response to the memory address decoder 112.

The term $1-F_1$ is generated by the 1's complement 145 by performing a 1's complement binary operation on the fraction value $F_1$. The multiplier 147 forms the product value of $P(1-F_1)$. The multiplier 149 forms the product value $P(1-F_1)B_j$. $B_j$ is the first term of the pair of data values read out from the note register 147 in response to the memory address decoder 112. The adder 150 sums the output product values from the multiplier 148 and the multiplier 149 to produce the data value corresponding to the first two terms on the right hand side of Eq. 4.

The data interpolator 116 is implemented in a manner analogous to that for the interpolator 115.

The present invention is not limited to a tone generation system in which master data sets which correspond to musical waveshapes are computed. An alternate system is one in which memories ae used to store preselected waveforms. A musical tone generation of this generic type is disclosed in U.S. Pat. No. 3,515,792 entitled "Digital Organ." This patent is hereby incorporated by reference.

Figure 5:
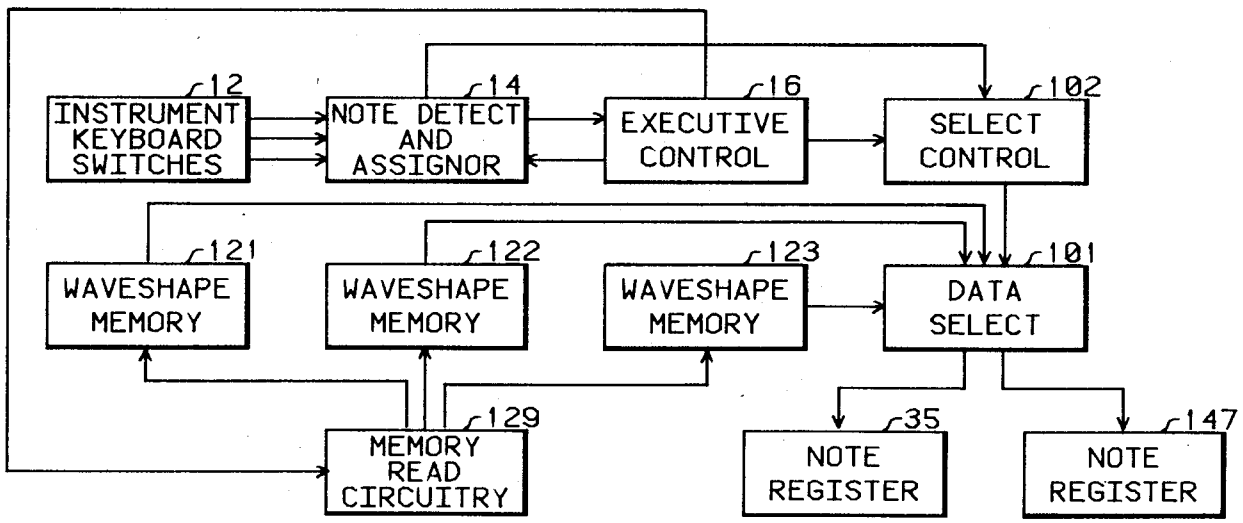
FIG. 5 is a system block diagram of an alternate system implementation.

FIG. 5 illustrates an alternate implementation of the present invention. Each of the plurality of waveshape memories 121–123 store a preselected set of data points corresponding to a musical waveshape. In response to signals created by the select control 102, the data select selects data points read out from two of the waveshape memories. The memory read out circuitry 129 is a memory addressing subsystem used to simultaneously read out waveshape data points stored in the plurality of waveshape memories. The selected sets of waveshape data points are stored in the note register 35 and the note register 147. The remainder of the tone generation system comprising the subsystem for reading data from the two note registers and the data interpolation is the same as that shown in FIG. 2 which has been previously described.

I claim:

1. In combination with a musical instrument having a plurality of keyboard switches whereby in response to a closure of a keyboard switch a plurality of data words corresponding to the amplitudes of evenly spaced points defining the waveform of a musical tone are computed in a sequence of computation cycles from a preselected set of harmonic coefficients and are transferred sequentially and converted into musical waveshapes at a rate proportional to the pitch of the musical tone being generated, apparatus for producing an ensemble tone effect comprising;

a plurality of harmonic coefficient memory means each storing a preselected set of harmonic coefficients, a first waveshape memory means, a second waveshape memory means, a harmonic addressing means for reading out harmonic coefficients from said plurality of harmonic coefficient memory means, a harmonic data select means whereby read out harmonic coefficients are selected from a subset of said plurality of harmonic coefficient memory means in response to a select control signal, a computing means responsive to said selected read harmonic coefficients whereby said amplitudes of evenly spaced points defining a first waveform of a musical tone are computed and stored in said first waveshape memory means and whereby said amplitudes of evenly spaced points defining a second waveshape of a musical tone are computed and stored in said second waveshape memory means, a first memory addressing means for reading out data words stored in said first waveshape memory means at a preselected first memory address advance rate and for reading out data words stored in said second waveshape memory means at said preselected first memory advance rate, a second memory addressing means for reading out data words stored in said second waveshape memory means at a preselected second memory advance rate, a waveshape combination computing means responsive to said select control signal whereby a sequence of interpolated data values are computed from said data words read out from said first waveshape memory means and from said data words are read out from said second waveshape memory means, and a conversion means whereby said sequence of interpolated data values is converted into an analog signal thereby producing said musical tone having an ensemble tone effect.

2. Apparatus according to claim 1 wherein said first memory addressing means comprises:

a detection means responsive to the closuure of a keyswitch in said plurality of keyboard switches wherein a detect signal is encoded to denote the closed keyswitch.

3. Apparatus according to claim 1 wherein said harmonic data select means comprises;

a select control signal generator whereby said select control signal is generated, and data select circuitry responsive to said select control signal whereby harmonic coefficients are selected from harmonic coefficients read out from a first one of said plurality of harmonic coefficient memory means and whereby harmonic coefficients are selected from harmonic coefficients read out from a second one of said plurality of harmonic coefficient memory means.

4. Apparatus according to claim 1 wherein said harmonic addressing means comprising;

a clock for providing timing signals, a word counter for counting said timing signals modulo the number of said plurality of data words corresponding to a period of said waveform of a musical tone, a harmonic counter incremented each time said word counter returns to its minimal count state, and a harmonic address decoder responsive to the count state of said harmonic counter whereby harmonic coefficients are read out from said plurality of harmonic coefficient memory means.

5. Apparatus according to claim 4 wherein said computing means comprises;

an adder-accumulator means comprising an accumulator wherein the count state of said harmonic counter is successively added to the contents of said accumulator in response to said timing signals, a sinusoid table for storing a plurality of trigonometric sinusoid function values, an address decoder means responsive to the content of said accumulator whereby an address signal is generated, a sinusoid addressing means for reading out a trigonometric sinusoid function value from said sinusoid table in response to said address signal, and a master data set computing means responsive to said trigonometric function value read out from said sinusoid table and to harmonic coefficients selected by said harmonic data select means whereby said plurality of data words corresponding to the amplitudes of evenly spaced points defining a first waveform of a musical tone are computed and stored in said first waveshape memory means and whereby said plurality of data words corresponding to the amplitudes of evenly spaced points defining a second waveshape of a musical tone are computed and stored in said second waveshape memory means.

6. Apparatus according to claim 2 wherein said detection means comprises;

a frequency number means for generating a frequency number in response to each said detect signal.

7. Apparatus according to claim 6 wherein said first memory addressing means comprises;

a first frequency adder-accumulator means, comprising an accumulator for successively adding said generated frequency number to the contents of said accumulator to produce a first accumulated frequency number in a binary digital format in which the individual bits of said first accumulated frequency number are arranged in an order ranging from the most significant bits to the least significant bits, and a first memory address decoder means whereby a data word is read out from said first waveshape memory means at an address corresponding to a preselected number of the most significant bits of said first accumulated frequency number.

8. Apparatus according to claim 7 wherein said second memory addressing means comprises;

a frequency number offset generator whereby said generated frequency number is modified by a preselected value, a second frequency adder-accumulator means, comprising an accumulator for successively adding said modified frequency number to the contents of said accumulator to produce a second accumulated frequency number in a binary digital numeric format in which the individual bits of said second accumulated frequency number are arranged in an order ranging from the most significant bits to the least significant bits, and a second memory address decoder means whereby a data word is read out from said second waveshape memory means at an address corresponding to a preselected number of the most significant bits of said second accumulated frequency number.

9. Apparatus according to claim 8 wherein said waveshape combination computing means comprises;

a first interpolation means whereby a first interpolated data point is computed from two consecutive data points read out from said first waveshape memory means in response to a preselected number of the least significant bits of said first accumulated frequency number, a second interpolation means whereby a second interpolated data point is computed from two consecutive data ponts read out from said second waveshape memory means in response to said preselected number of the least significant bits of said first accumulated frequency number, a third interpolation means whereby a first composite interpolated data point is computed from said first interpolated data point and said second interpolated data point in response to said select control signal, a fourth interpolation means whereby a third interpolated data point is computed from two consecutive data points read out from said second waveshape memory means in response to a preselected number of the least significant bits of said second accumulated frequency number, a fifth interpolation means whereby a second composite interpolated data point is computed from said first interpolated data point and said third interpolated point in response to said select control signal, and interpolation combination means whereby said sequence of interpolated data values are created by combining each of said first composite interpolated data points and each of said second composite interpolated data points.

10. In combination with a keyboard operated musical instrument having a plurality of keyswitches, apparatus for producing a musical tone having an ensemble effect comprising;

a detection means responsive to a closure of a keyswitch in said plurality of keyswitches whereby a detect signal is encoded to denote the closed keyswitch, a plurality of waveshape memory means each storing a set of data points corresponding to a preselected musical waveshape, a waveshape addressing means for reading out data points from said plurality of waveshape memory means, a first waveshape storage means, a second waveshape storage means;

a waveshape data select means whereby in response to a select control signal read out data points from the first one of said plurality of waveshape memory means are selected and are stored in said first waveshape storage means and whereby read out data points from a second one of said plurality of waveshape memory means are selected and are stored in said second waveshape storage means, a first memory addressing means for reading out data words from said first waveshape storage means at a preselected first memory address advance rate and for reading out data words from said second waveshape storage means at said preselected first memory advance rate, a second memory addressing means for reading out data words from said second waveshape storage means at a preselected second memory address advance rate, a waveshape combination computing means responsive to said select control signal whereby a sequence of interpolated data values are computed from said data words read out from said first waveshape storage means and from said data words read out from said second waveshape storage means, and a conversion means whereby said sequence of interpolated data values is converted into an analog signal thereby producing said musical tone having an ensemble tone effect.

11. Apparatus according to claim 10 wherein said detection means comprises;

a frequency number means for generating a frequency number in response to each said detect signal.

12. Apparatus according to claim 10 wherein said waveshape data select means comprises;

a select control signal generator whereby said select control signal is generated, and data select circuitry responsive to said select control signal whereby data points read out from said plurality of waveshape memory means are selected and stored in said first waveshape storage means and in said second waveshape storage means.

13. Apparatus according to claim 11 wherein said first memory addressing means comprises;

a first frequency adder-accumulator means, comprising an accumulator for successively adding said generated frequency number to the contents of said accumulator thereby producing a first accumulated frequency number in a binary digital numeric format in which the individual bits are arranged in an order ranging from the most significant bits to the least significant bits, and a first memory address decoder means whereby a data word is read out from said first waveshape storage means at an address corresponding to a preselected number of the most significant bits of said first accumulated frequency number.

14. Apparatus according to claim 13 wherein said second memory addressing means comprises:

a frequency number offset generator whereby said generated frequency number is modified by a preselected value, a second frequency adder-accumulator means, comprising an accumulator, for successively adding said modified frequency number to the contents of an accumulator to produce a second accumulated frequency number in a binary digital numeric format in which the individual bits are arranged in an order ranging from the most significant bits to the least significant bits, and a second memory address decoder whereby a data word is read out from said second waveshape storage means at an address corresponding to a preselected number of the most significant bits of said second accumulated frequency number.

15. Apparatus according to claim 14 wherein said waveshape combination means comprises;

a first interpolation means whereby a first interpolated data point is computed from two consecutive data points read out from said first waveshape memory means in response to a preselected number of the least significant bits of said first accumulated frequency number, a second interpolation means whereby a second interpolated data point is computed from two consecutive data points read out from said second waveshape memory means in response to said preselected number of the least significant bits of said first accumulated frequency number, a third interpolation means whereby a first composite interpolated data point is computed from said first interpolated data point and said second interpolated data point in response to said select control signal, a fourth interpolation means whereby a tnhird interpolated data point is computed from two consecutive data points read out from said second waveshape memory means in response to a preselected number of the least significant bits of said second accumulated frequency number, a fifth interpolation means whereby a second composite interpolated data point is computed from said first interpolated data point and said third interpolated point in response to said select control signal, and interpolation combination means whereby said sequence of interpolated data values are created by combining each of said first composite interpolated data points and each of said second composite interpolated data points.

* * * * *